United States Patent [19]

Golland et al.

[11] 3,953,250

[45] Apr. 27, 1976

[54] METHOD FOR PRODUCING WIRE WITH A SMALL CROSS-SECTIONAL AREA

[75] Inventors: David I. Golland, Cary; Bernhard T. Junker, Raleigh; Gary E. O'Connor, Raleigh; Charles J. Runkle, Raleigh, all of N.C.

[73] Assignee: Monsanto Company, St. Louis, Mo.

[22] Filed: Oct. 30, 1974

[21] Appl. No.: 519,364

[52] U.S. Cl. ..... 148/36; 29/193; 83/56; 83/926 B

[51] Int. Cl.[2] ..... B21C 37/04; C22C 29/00

[58] Field of Search ..... 83/56, 926 B; 29/415, 29/193, 414; 148/36

[56] References Cited

UNITED STATES PATENTS 2,074,713 3/1937 Tross ..... 29/415

*Primary Examiner*—Willie G. Abercrombie

*Attorney, Agent, or Firm*—Donald J. Fitzpatrick

[57] ABSTRACT

A method for producing wire with a small cross-sectional area and good mechanical properties is disclosed. The method comprises the steps of providing metallic coil stock of blackplate thickness with a specific microstructure and an essentially uniform cross-section, positioning in engaging relationship a pair of monolithic cutting rolls, feeding the stock into the nip formed by the rolls and then slitting the stock by shear fracture into wire with an aspect ratio of less than about 25. The method is characterized by an extended life of the cutting rolls.

20 Claims, 5 Drawing Figures

METHOD FOR PRODUCING WIRE WITH A SMALL CROSS-SECTIONAL AREA

BACKGROUND OF THE INVENTION

1. Field of the Invention

This invention relates to a method for producing wire and more particularly to a method for producing wire for reinforcing rubber articles from cold rolled steel coils.

2. Description of the Prior Art

Steel wire is conventionally manufactured by preparing a melt of a specific composition, casting the melt, thermomechanically working the cast product, and wire drawing. Frequent intermediate annealing is required to restore ductility in order to achieve substantial reductions in cross-sectional area. To produce fine diameter, high carbon wire of approximately 20 mils and smaller coupled with specific mechanical properties or microstructure is quite expensive. The wire is expensive because of a low product yield and the numerous processing steps required to ultimately arrive at the final diameter and specific mechanical properties or microstructure.

As used herein the term "wire" is defined as a product with a filamentary or ribbon-like shape characterized by a small cross-sectional area. Furthermore, the actual cross-section can be round or flat.

The terms round wire, flat wire, ribbon or filament may be interchanged in this specification. However, the product referred to is always one with a small cross-sectional area.

In U.S. Pat. No. 2,074,713 a method is disclosed for making wire from sheet metal. Sheet metal is rolled through a grooving mechanism so as to provide channels on opposite sides of a sheet which define the wires to be produced. The channels are subsequently separated by passing the sheet through a shearing apparatus thereby providing a plurality of wire-like elements of polygonal cross-section. The disclosed process is suitable for producing stock for welding rods. Such rods are generally much larger in diameter than 20 mils.

Another method for producing wire is to roll round rod into flat wire in those instances where slitting as a method of production is either very difficult or impossible. It is known in the prior art that this technique is applicable for producing wire with aspect ratios of more than 100.

In volume 3 of the Steel Wire Handbook, 1972 edition, at page one there is the implication that obtaining wire with a small cross-sectional area is not practical or possible by slitting. Furthermore, the prior art is devoid of a method for producing such small cross-sectional wire by slitting so that the slit product has an aspect ratio of less than about 25 and for realizing an extended knife life during slitting.

The method of the present invention produces wire with a small cross-sectional area and good mechanical properties by slitting steel strip wherein the slitting is characterized by extended knife life.

SUMMARY OF THE INVENTION

The present invention relates to a method for obtaining wire by slitting light gage strip in coil form particularly blackplate wherein blackplate is defined, as a product of the cold reduction method in gages No. 29 and lighter (thicknesses 0.0141 inch and under). The blackplate coil stock must have an essentially uniform cross-section, a homogeneous microstructure and be substantially free of proeutectoid ferrite. For a commercially economical slitting operation, knife life is a critical characteristic. This particular structure is essential in order for the slitting cutters or knives to have an extended life or shown minimum wear. The coil stock must fail by shear fracture during slitting. If proeutectoid ferrite is present in the microstructure failure will occur by tearing. Such a failure accelerates knife wear and also produces a slit product with pronounced burrs and distorted cross-section. A wire with such a contour generally exhibits very poor fatigue resistance. The slit wire must also be capable of responding to rapid austenitization. A microstructure that contains proeutectoid ferrite will not respond to rapid austenitization and the final wire product will exhibit inferior mechanical properties.

The method of the present invention allows strip to be rapidly and economically converted into high quality wire. The invention comprises the following steps:

Providing a strip of blackplate thickness with a homogeneous microstructure, substantially free of proeutectoid ferrite and an essentially uniform cross-section; positioning in engaging relationship a pair of rotating monolithic cutting rolls; feeding the strip into the nip formed by the rotating monolithic cutting rolls; and slitting the strip by shear fracture into wire with an aspect ratio of less than about 25. As hereinafter used in this specification aspect ratio is defined as: width of slit product/thickness of stock.

It is therefore an object of this invention to provide a method for converting strip into wire with a small cross-sectional area of less than about $7 \times 10^{-4}$ sq. in.

Another object of this invention is to provide a method wherein blackplate is slit into wire wherein fracture during slitting is by the shear mode.

A further object of this invention is to provide a method for slitting blackplate wherein the slitting cutters have an extended knife-life.

Still a further object of this invention is to provide a method for obtaining wire for reinforcing rubber articles from blackplate.

Another object of this invention is to provide a method for obtaining wire for reinforcing pneumatic tires by slitting steel strip.

A further object of this invention is to provide a wire that has a good response to austenitization.

DETAILED DESCRIPTION OF THE PREFERRED EMBODIMENT

Figure 1:
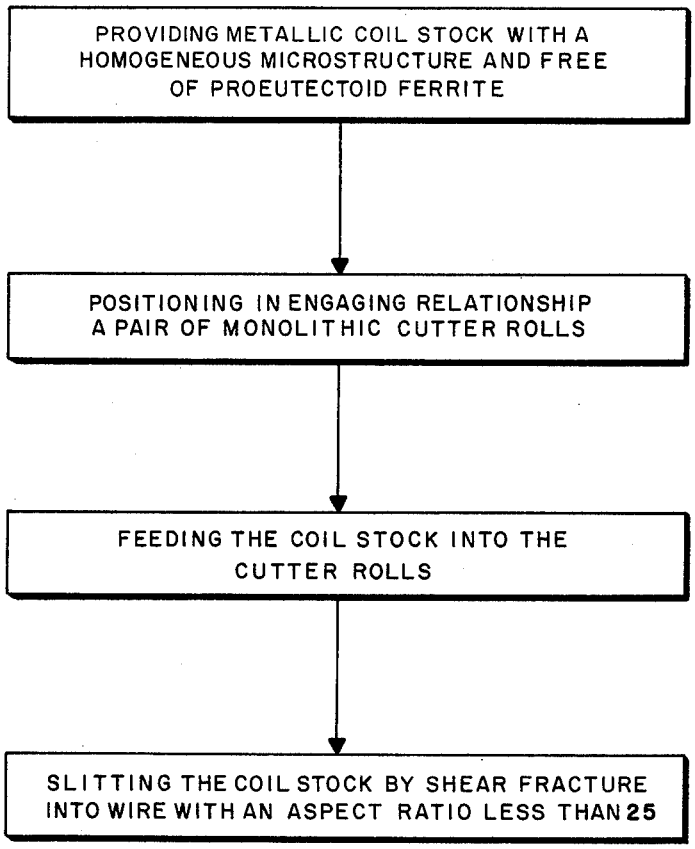
FIG. 1 is a flow sheet of the method of this invention.

The present invention provides a method for the production of wire having a small cross-sectional area and good mechanical properties by slitting steel strip. The invention hereinafter more fully described contemplates a method characterized by an extended knife-life of the cutter apparatus.

The method for the production of such wire comprises the steps of:

a. providing a strip of blackplate thickness with a homogeneous microstructure, an essentially uniform cross-section and substantially free of proeutectoid ferrite, b. positioning in engaging relationship a pair of rotating monolithic rolls, c. feeding the strip into the nip formed by said monolithic rolls, and d. slitting the strip by shear fracture into wire with an aspect ratio of less than about 25.

In carrying the invention into practice, it is important that the microstructure of the strip be substantially free of proeutectoid ferrite. This microstructure is important for the following reasons: increased knife life, acceptable mechanical properties resulting from an adequate response to subsequent heat treatment for the slit product and a slit contour that exhibits good fatigue resistance of the slit product.

It has been shown that there is a relationship between knife life and microstructure. As will be more fully discussed when specific reference to the accompanying figures is made this relationship will be developed. For the method of this invention to be economically feasible and competitive with conventionally drawn wire, extended knife life is a prime criterion. It has been determined that the microstructure of the incoming strip must be essentially free of proeutectoid ferrite for a satisfactory knife life to be realized. As used herein the terms "knives" and "cutters" are interchangeable and synonymous in all respects.

Before the slit product can be used as a reinforcing member it may be subjected to a heat treatment so that the final microstructure will be tempered martensite. Such a structure is required in order to meet specific mechanical properties. To achieve the desired tempered martensitic structure the slit product must have an adequate response to austenitization. If proeutectoid ferrite is present such a response cannot be had. Therefore to obtain the desired mechanical properties in the finished product, proeutectoid ferrite must be absent from the incoming strip.

Furthermore, if the slit product is to be employed as reinforcing member it must have good fatigue resistance. If the microstructure contains more than a trace of proeutectoid ferrite, slitting will occur by tearing or in the tensile mode rather than by fracture in the shear mode and the contour of the resultant slit product will be irregular and contain burrs. It is well known in the art that such a contour will have inferior fatigue resistance. To obtain wire with satisfactory fatigue resistance the contour of the slit product must be regular and burr free. This can only be obtained by having the strip fail through the shear mode. A structure devoid of proeutectoid ferrite will fracture in the desired manner.

The production of wire according to the present invention is accomplished in the following manner. Reference is made to FIG. 1 wherein the basic steps of the invention are shown in a flow sheet. First steel strip of blackplate gage thickness, that is, less than No. 29 gage or 0.0141 inches thick is provided. Steel of this thickness is used because wire produced by the method of this invention can be used to make steel wire cords for reinforcing rubber articles such as pneumatic tires. In pneumatic tires the individual metallic wires are generally of a diameter less than 0.010 inches or 10 mils. The coil may typically have a chemical composition of about C1050 up to about C1070. The microstructure of the strip does not contain proeutectoid ferrite and is generally all fine pearlite, bainitic or martensitic. A typical steel is that described in a copending application, Continuous Carburization Method, Ser. No. 519,365, filed Oct. 30, 1974 and assigned to the assignee of this application.

Figure 2:
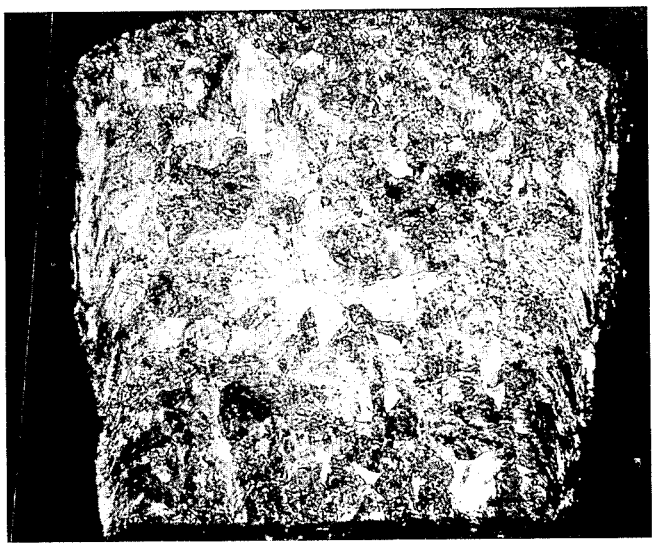
FIG. 2 is a photomicrograph showing the cross-section of a slit wire wherein the microstructure is essentially pearlitic.
Figure 3:
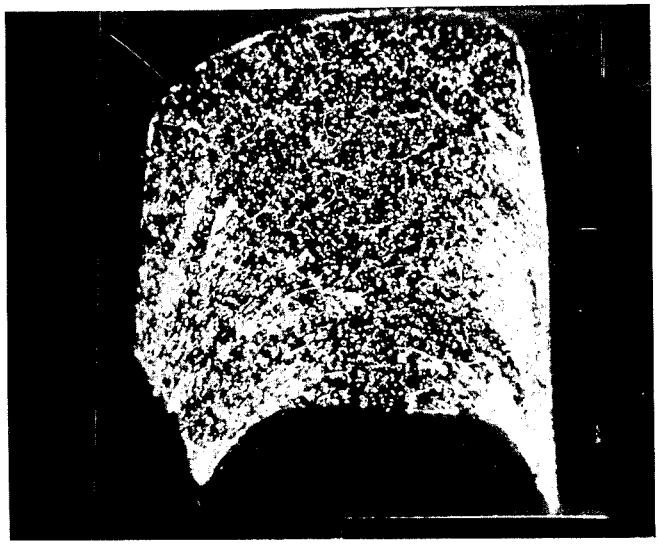
FIG. 3 is a photomicrograph showing the cross-section of a slit wire wherein the microstructure is essentially spheroidized cementite.
Figure 4:
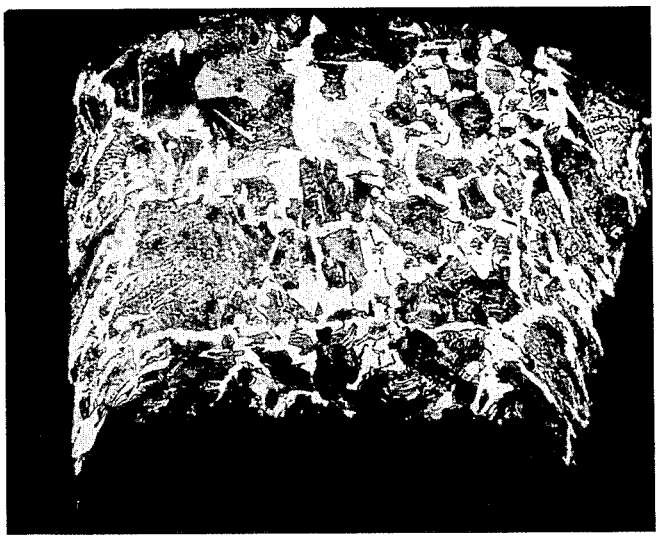
FIG. 4 is a photomicrograph showing a cross-section of a slit wire wherein the microstructure contains a substantial amount of proeutectoid ferrite.

The significance of the strip microstructure is illustrated in FIGS. 2, 3 and 4.

FIG. 2 is a photomicrograph showing the cross-section of a slit wire wherein the microstructure is fine pearlite. This structure is relatively hard and notch sensitive since the carbides are present as platelets which effectively reinforce the thin ferrite lamellae. The soft phase of proeutectoid ferrite is completely absent. The wire cross-section shows little plastic deformation, minimum burr formation and a fairly square cross-section with smooth and planar sides. FIG. 3 is a photomicrograph showing the cross-section of a slit wire wherein the microstructure contains spheroidized cementite. FIG. 4 is a photomicrograph showing the cross-section of a slit wire wherein considerable proeutectoid ferrite and coarse pearlite are present.

The wire cross-sections shown in FIGS. 3 and 4 are unsatisfactory and such wires would not achieve the objects of this invention because they are distorted and contain an excessive burr formation. The distortion was caused by the presence of softer microstructural phases, i.e., spheroidized cementite and proeutectoid ferrite. These softer phases permitted considerable plastic deformation before fracture. The extent of plastic flow, as shwon in these figures, of the slit surfaces results in greater burr formation and distorted cross-sections than in a wire with a microstructure devoid of soft phases.

Steel with the requisite microstructure is then fed into the nip of a pair of revolving monolithic cutting rolls arranged in engaging relationship. These cutting rolls are described in a copending application Apparatus for Slitting Coil Stock, Ser. No. 519,173, filed Oct. 30, 1974 and assigned to the assignee of this application. The apparatus described in this copending application recites as a principal component a pair of monolithic cutting rolls arranged in a predetermined spaced manner. The strip microstructure controls this predetermined spacing between the cutting rolls. For example, if the feed stock has a martensitic microstructure very little, if any, spacing or engagement is required because the strip will fail easily in the shear mode. However, feed stock containing a phase softer than martensite such as fine pearlite will require a greater engagement of the cutters to initiate cracking and shear failure. To slit strip with a pearlitic microstructure the spacing between the cutters is reduced so as to partially fracture the strip. In order for cold rolled strip such as black plate to be economically converted into wire, cutter or knife wear must be minimal and the life of these elements must be reasonably long. Slitting performance is measured by knife wear. Knife wear is the progressive wearing of the knives during continued slitting of the steel strip. This resulting change in the geometry of the knives can affect the fracture mode and burr formation so that the resulting contour of the slit wire will be such that poor fatigue life may result. Many factors affect knife life such as strip elongation, hardness, surface finish, microstructure and strip analysis. We have been able to successfully control one of these factors, namely, strip microstructure.

Figure 5:
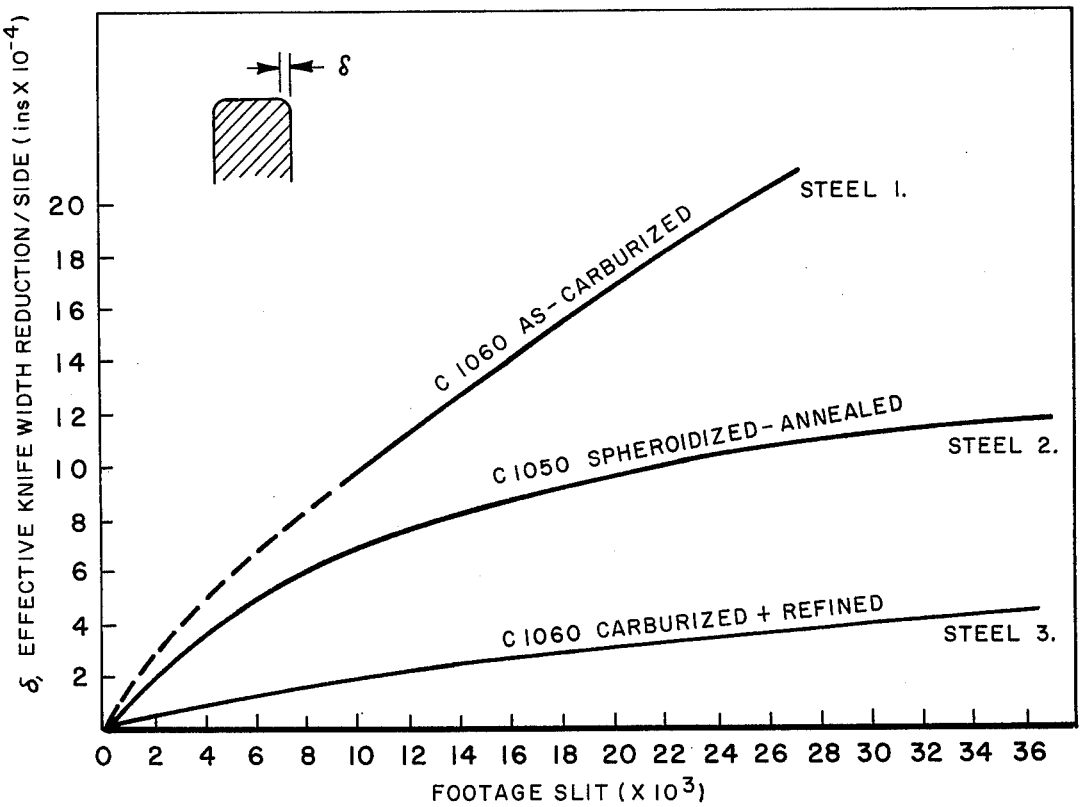
FIG. 5 is a graph depicting knife-life versus microstructure.

The relationship between cutter life and strip microstructure of the strip is shown in FIG. 5. Steel number 1 has a nominal C1060 composition, and a microstructure consisting of coarse pearlite and proeutectoid ferrite. There is considerable inter-lamellae spacing between the carbide platelets and a substantial amount of proeutectoid ferrite is present. Steel 2 has a nominal C1050 composition and a microstructure consisting of small globular carbides in a continuous phase of proeutectoid ferrite. Steel 3 has a nominal C1060 composition and a microstructure consisting of substantially all fine pearlite. Cutter life is measured by comparing the footage slit to the wear of the cutter as shown by the reduction in knife width. At a slit footage of 20,000 feet it is readily apparent that steel No. 3 has the least amount of knife wear, that is about $3 \times 10^{-4}$ inches width reduction per side whereas steel No. 1 has the greatest amount of knife wear, namely about $16.5 \times 10^{-4}$ inches width reduction per side.

Failure in the tensile mode produces wire with a distorted cross-section whereas failure in the shear mode produces wire with a generally square or rectangular cross-section. As previously discussed FIGS. 2, 3 and 4 show the cross-sections of wire that have failed by shear and tensile fracture. It is reasonable to assume that the Fatigue Endurance Limit (FEL) will be higher for the steel shown in FIG. 2 than for the steels shown in FIGS. 3 and 4 because the cross-section contour is not distorted whereas the cross-section contours of the other steels show considerable plastic deformation by tensile fracture. Heavily distorted areas are sites for initiation of fatigue failure.

If the slit product is to receive a subsequent heat treatment in order to enhance the mechanical properties the strip must respond to rapid austenitization so that upon quenching, a martensitic structure is produced having both uniform carbon distribution and extremely fine grain size. This microstructure is necessary in order that the wire produced by the method of this invention satisfy the requirements of its intended use, namely as a tire cord. It has been determined that optimum tire cord properties can be obtained if the wire reinforcing member has a fine martensitic microstructure.

Strip such as that illustrated in FIG. 4 wherein the microstructure has an extremely inhomogeneous distribution of carbon, i.e., large areas of proeutectoid ferrite, did not respond to a rapid austenitization. In order to achieve satisfactory properties with this material the structure has to initially be homogenized at an elevated temperature at about 1050°C. in order to effect a uniform distribution of carbon. Such a heat treatment however, was not entirely satisfactory because excessive grain growth resulted in very coarse martensite upon quenching. A second austenitization at a lower temperature of approximately 800°C. was required to refine the coarse martensitic structure and improve mechanical properties. Sample No. 1 represents material that received this double heat treatment. Sample No. 2 represents material that responds satisfactorily to austenitization. This material is strip such as illustrated in FIG. 2, namely a microstructure of fine pearlite. The results of such heat treatments and response to austenitization are shown in accompanying Table I.

TABLE 1

| Sample | Heat Treatment Austenitizing Temperature | Line Speed | Tensile KSI |
|---|---|---|---|
| Microstructure before heat treatment | | | |
| 1. coarse pearlite and considerable proeutectoid ferrite | (a)1050°C<br>(b) 800°C | 50'/min<br>100'/min | —<br>315 |
| 2. fine pearlite | 800°C | 150'/min | 330 |

The results of extensive laboratory investigation of steel produced by varying the steps of this invention can be summarized as follows in the accompanying Table II wherein a rating of 1 signifies best properties, a rating of 2 signifies intermediate properties and a rating of 3 signifies inferior properties.

TABLE II

| Microstructure of Strip | Knife Life | Shape of Slit Wire | Response to Heat Treatment |
|---|---|---|---|
| a) Fine pearlite, or Bainite | 1 | 1 | 1 |
| b) Spheroidized cementite and proeutectoid ferrite | 2 | 2 | 3 |
| c) Coarse pearlite and proeutectoid ferrite | 3 | 3 | 2 |

The method of the present invention can be illustrated by the following examples. These examples are merely illustrative and are not intended as limitations upon the scope of the invention described herein.

EXAMPLE I

1. A 24 inch wide, 10 mil black plate coil approximately 3,000 feet long with an AISI C1008 analysis was carburized to about 0.60% carbon. The strip microstructure was predominantly fine pearlite.

2. The carburized coil was rough slit into 23, 1 inch coil plus scrap.

3. The one inch coils were intermediate slit into 4, 0.228 inch wide multiples.

4. The 0.228 inch multiples were fine slit into 24, 10 mil by 10 mil wires. The wire shape was essentially square showing a shear fracture with smooth planar sides and minimum burr formation. An aspect ratio of 1.0 was employed.

5. After slitting 30,000 feet cutter wear was $4 \times 10^{-4}$ inches per side.

6. The wires were twisted into a $1 \times 5$ tire cord and heat treated to tempered martensite.

7. The mechanical properties of this product are: U.T.S. - 318–322KSI; elongation 3.0 to 3.3% and F.E.L. ($10^6$ cycles) approximately 95 KSI.

EXAMPLE II

Steps 1 through 3 are the same as Example I.

4. The 0.228 inch multiples were fine slit into 4, 10 mil by 40 mil ribbons. The wire shape was essentially rectangular showing a shear fracture with smooth planar sides and minimum burr formation. An aspect ratio of 4.0 was employed.

5. Knife wear was substantially the same as Example I.

6. Single ribbons were heat treated to tempered martensite.

7. The mechanical properties of this product are: U.T.S. - 340 KSI; and elongation — 3.3 to 3.5%.

EXAMPLE III

1. A 30 inch wide, 10 mil coil, approximately 10,000 feet long with an AISI C1050 analysis and a spheroidized annealed microstructure was rough slit into 1 inch wide coils.

2. The one inch coils were intermediate slit into 4, 0.228 inch wide multiples.

3. The 0.228 inch multiples were fine slit into 24, 10 by 10 mil wires. The wire shape was slightly distorted showing evidence of some tensile fracture. An aspect ratio of 1.0 was employed.

4. After slitting 30,000 feet cutter wear was $11 \times 10^{-4}$ inches per side.

5. The wires were twisted into a $1 \times 5$ tire cord and heat treated to tempered martensite.

6. The mechanical properties of this product are: U.T.S. 332KSI; elongation 4.2% and F.E.L. ($10^6$ cycles) approximately 60 KSI.

It has been found that the method of this invention is broadly applicable to slitting blackplate into wire with an aspect ratio of less than about 25, on an intermediate level the invention is applicable to slitting blackplate into wire with an aspect ratio of less than about 15, while on a preferred basis an aspect ratio of less than 10 is selected. For a large number of rubber reinforcing end uses an aspect ratio of less than 5 is chosen.

We claim:

1. A method for producing wire with a small cross-sectional area and good mechanical properties by slitting steel strip wherein said slitting is characterized by an extended knife life, comprising the steps of:

a. providing blackplate coil stock with a homogeneous microstructure, an essentially uniform cross-section and substantially free of proeutectoid ferrite;

b. positioning in engaging relationship a pair of monolithic cutting rolls;

c. feeding said stock into the nip formed by said cutting rolls; and d. slitting said stock by shear fracture into wire having an aspect ratio of less than about 25 to 1.

2. The method as recited in claim 1 wherein step (a) further comprises providing a coil of blackplate wherein said microstructure is essentially fine pearlite.

3. The method as recited in claim 1 wherein step (a) further comprises providing a coil of blackplate wherein said microstructure is essentially bainitic.

4. The method as recited in claim 1 wherein step (a) further comprises providing a coil of blackplate wherein said microstructure is essentially tempered martensite.

5. The method as recited in claim 1 wherein step (d) further comprises slitting said stock into wire with an aspect ratio of less than about 15 to 1.

6. The method as recited in claim 1 wherein step (d) further comprises slitting said stock into wire with an aspect ratio of less than 10 to 1.

7. The method as recited in claim 1 wherein step (d) further comprises slitting said stock into wire with an aspect ratio of less than 5 to 1.

8. The method as recited in claim 7 wherein step (d) further comprises slitting said stock into wire with a cross-sectional area of less than $7 \times 10^{-4}$ sq. in.

9. A method for producing steel wire with a cross-sectional area of less than $7 \times 10^{-4}$ sq. in. for reinforcing rubber articles by slitting steel strip wherein said slitting is characterized by an extended knife life, comprising the steps of:

a. providing blackplate coil stock with a homogeneous microstructure, an essentially uniform cross-section and substantially free of proeutectoid ferrite;

b. positioning in engaging relationship a pair of monolithic cutting rolls;

c. feeding said strip into the nip formed by said cutting rolls; and d. slitting said strip by shear fracture into wire having an aspect ratio of less than 5 to 1.

10. The method as recited in claim 9 wherein said coil stock contains at least 0.50% carbon and a microstructure of essentially fine pearlite.

11. The method as recited in claim 10 wherein said microstructure is essentially bainitic.

12. The method as recited in claim 9 wherein said step (d) further comprises slitting said coil stock into wire with an aspect ratio of less than about 3 to 1.

13. The method as recited in claim 9 wherein step (d) further comprises slitting said coil stock into wire with an aspect ratio of less than about 1.5 to 1.

14. A method for producing wire with a small cross-sectional area comprising the steps of:

a. providing steel coil stock with an essentially homogeneous microstructure and substantially free of proeutectoid ferrite;

b. positioning a pair of monolithic cutting rolls;

c. feeding said stock into the nip formed by said cutting rolls; and d. slitting said stock into wire having an aspect ratio of less than about 25 to 1.

15. A steel wire for reinforcing rubber articles, comprising:

a cross-section having an aspect ratio less than 25 to 1, an essentially homogeneous microstructure substantially free of proeutectoid ferrite, a pair of slit edges and a small cross-sectional area.

16. The steel wire of claim 15 wherein said microstructure is essentially fine pearlite.

17. The steel wire of claim 15 wherein said microstructure is essentially bainitic.

18. The steel wire of claim 15 wherein said microstructure is essentially martensitic.

19. The steel wire of claim 15 having at least 0.50 percent by weight of carbon.

20. A method for producing steel wire by slitting steel strip, comprising the steps of:

a. providing coil stock with a homogeneous microstructure, substantially free of proeutectoid ferrite;

b. feeding said stock into the nip formed by a pair of cutting rolls; and c. slitting said stock into wire having an aspect ratio of less than about 25 to 1.

* * * * *